US008388418B2

(12) United States Patent
Greer

(10) Patent No.: US 8,388,418 B2
(45) **Date of Patent: *Mar. 5, 2013**

(54) THUMB-OPERATED DETACHABLE LIQUID POLISH DISPENSER FOR A HAND-HELD SURFACE FINISHING POWER TOOL

(76) Inventor: Robert Steven Greer, Rancho Cordova, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/273,121

(22) Filed: Oct. 13, 2011

(65) Prior Publication Data

US 2012/0034854 A1 Feb. 9, 2012

Related U.S. Application Data

(63) Continuation-in-part of application No. 12/262,542, filed on Oct. 31, 2008, now Pat. No. 8,246,423.

(60) Provisional application No. 61/394,272, filed on Oct. 18, 2010, provisional application No. 61/003,145, filed on Nov. 14, 2007.

(51) Int. Cl.
*B24B 27/08* (2006.01)

(52) U.S. Cl. ..... 451/358; 451/359; 451/446

(58) Field of Classification Search ..... 451/358, 451/359, 446

See application file for complete search history.

(56) References Cited

U.S. PATENT DOCUMENTS

| | | | | |
|---|---|---|---|---|
| 1,925,925 | A | | 9/1933 | Kintzing |
| 1,931,893 | A | | 10/1933 | Fleming et al. |
| 1,952,910 | A | | 3/1934 | Decker |
| 2,061,052 | A | | 11/1936 | Turak |
| 3,085,269 | A | | 4/1963 | Greer |
| 3,104,783 | A | * | 9/1963 | Hall ..... 222/191 |
| 3,110,993 | A | | 11/1963 | Grage |
| 3,277,924 | A | * | 10/1966 | Nezworski ..... 239/304 |
| 3,293,678 | A | | 12/1966 | South |
| 4,091,577 | A | | 5/1978 | Ortiz |
| 4,102,084 | A | | 7/1978 | Bloomquist |
| 4,383,345 | A | | 5/1983 | Alexander |
| 4,523,411 | A | | 6/1985 | Freerks |
| 4,773,120 | A | | 9/1988 | Wang |
| 4,780,992 | A | | 11/1988 | McKervey |
| 5,201,953 | A | | 4/1993 | Lowry |
| 5,309,594 | A | | 5/1994 | Thompson |
| 5,638,993 | A | * | 6/1997 | Hing ..... 222/191 |
| 5,649,508 | A | * | 7/1997 | Rost et al. ..... 222/191 |
| 6,132,301 | A | | 10/2000 | Kaiser |
| 6,176,396 | B1 | | 1/2001 | Hamada et al. |
| 6,413,238 | B1 | * | 7/2002 | Maget ..... 604/132 |
| 6,434,774 | B1 | | 8/2002 | Castellon |
| 6,560,806 | B1 | * | 5/2003 | Lawson et al. ..... 8/158 |
| 6,655,866 | B1 | * | 12/2003 | Morad et al. ..... 401/139 |
| 6,669,391 | B2 | * | 12/2003 | Policicchio et al. ..... 401/270 |
| 7,115,018 | B1 | * | 10/2006 | Syverson ..... 451/6 |
| 7,144,312 | B2 | | 12/2006 | Boyle |
| 7,189,154 | B1 | | 3/2007 | Karppinen et al. |
| 7,363,673 | B2 | | 4/2008 | Schonewille et al. |
| 7,364,499 | B1 | * | 4/2008 | Karppinen et al. ..... 451/449 |
| 2002/0166573 | A1 | * | 11/2002 | Policicchio et al. ..... 134/6 |
| 2007/0012727 | A1 | * | 1/2007 | Licari ..... 222/167 |

* cited by examiner

*Primary Examiner* — Maurina Rachuba
(74) *Attorney, Agent, or Firm* — Kilpatrick Townsend & Stockton LLP

(57) ABSTRACT

An elongated liquid polish dispenser is described that can be secured to and released from a bracket that stays on a hand-held rotary buffer such that a switch on the polisher is in a convenient position for an operator to press while gripping the polisher. A portion of the dispenser can be inserted through a hole in the bracket, and the entire dispenser can be rotated so that tabs securely attach the dispenser to the bracket and tool. The switch activates an electric pump which pumps liquid polish through a nozzle and onto a work surface.

20 Claims, 11 Drawing Sheets

THUMB-OPERATED DETACHABLE LIQUID POLISH DISPENSER FOR A HAND-HELD SURFACE FINISHING POWER TOOL

CROSS-REFERENCES TO RELATED APPLICATIONS

This application claims the benefit of U.S. Provisional Application No. 61/394,272, filed Oct. 18, 2010, and is a continuation-in-part of U.S. application Ser. No. 12/262,542, filed Oct. 31, 2008 , which claims the benefit of U.S. Provisional Application No. 61/003,145 filed Nov. 14, 2007. The above applications are hereby incorporated by reference in their entireties for all purposes.

BACKGROUND

This invention relates generally to devices that attach to power tools and dispense fluid on a work surface, and more particularly to thumb-operated devices that attach to hand-held polishers wherein a work facilitating or enhancing liquid is dispensed from the devices onto surfaces to be polished or buffed.

Hand-held surface finishing power tools, such as hand-held rotary polisher 102 in FIG. 1, are well-known in the art. Rotary polishers are often used by original equipment manufacturers, auto body shops, and professional detailers to sand, polish, or otherwise finish surfaces on vehicles such as automobiles, recreational vehicles, boats, aircraft, and other vehicles. Rotary polishers can be used for polishing other surfaces as well, such as those on buildings, bridges, and other structures. Rotary polishers are sometimes called rotary buffers, variable speed buffers, buffing or polishing machines, circular polishers, or orbital polishers. Some exemplary rotary polishers include the DeWalt DW849 7"/9" Electronic Variable Speed Polisher, Milwaukee 5460 7/9 in. Dial Speed Control Polisher, Makita 9227C 7" Electronic Sander-Polisher, and Porter Cable 7424 6" Variable-Speed Random-Orbit Polisher.

Rotary polisher 102 includes rotatably attached finishing disk 104 comprising disk-like backing pad 112 upon which a buffing pad 106 can be placed. While a user holds the polisher against a work surface, the polisher rotates the buffing pad against the work surface at a range of angular velocities depending upon the model, e.g., 600, 1000, 1800, 3000, or 3600 revolutions per minute (RPM). Some models of buffing machines have variable speeds which allow a user to control the angular velocity or rotation speed of the tool. Some models have an adjustable governor setting which limits rotation speed, which can be used for more sensitive operations where too much speed could cause damage to the work surface. Non-rotary surface finishing power tools are also available, such as those that vibrate a pad or employ a belt.

On many hand-held polishers, the speed of the device is controlled by a trigger switch on a handle, such as speed control trigger 108 on handle 110 of polisher 102. The placement of speed control trigger 108 allows a user to grip handle 110 with one hand and comfortably depress speed control trigger 108 with the same hand's index finger, thereby allowing an uninterrupted grip of handle 110. The user's other hand can hold a handle (not shown) on the distal end of the polisher to direct and stabilize finishing disk 104 on a work surface.

On other hand-held polishers, such as those for home use, the speed of the device is controlled by a switch integrated into the main housing of the polisher. There may be several speed selections, or simply an 'on/off' switch. One grips the main housing, which is generally elongated and perpendicular to the normal of the polishing surface.

A wide variety of attachments can serve as finishing disk 104 on rotary polisher 102. Finishing disks can include sisal wheels, spiral sewn cotton wheels, loose cotton wheels, canton flannel wheels, acrylic buffing wheels, treated spiral sewn wheels, scrubber wheels, cushion buffs, denim buffing wheels, domet flannel wheels, expanding sander wheels, facer buffs, finger buffs, flap wheels, mushroom buffs, sanding drums, razor buffs, scrubbing mushroom buffs, string buffs, vented buffs, treated vented buffs, and other finishing attachments. Circular buffing pad 106 wraps around rigid or semi-rigid backing pad 112, which can be made of rubber, phenolic resin, metal, or other types of suitable material. A backing pad is sometimes called a back-up plate. Because of the way buffing pad 106 wraps around backing pad 112, buffing pad is sometimes called a polishing bonnet. Other styles of buffing pads include those that attach to the backing pad by hook-and-loop fasteners (e.g., VELCRO®). Buffing pad 106 can be made of soft fabric, such as cotton, wool, nylon, or foam and are often between ⅞ and 1¼ inches thick.

Power polishers and sanders are somewhat interchangeable, depending on the job. By attaching a fine sanding disk to rotary polisher 102, the polisher can sand a surface.

The finishing pad employed often depends upon the material of the surface to be finished (e.g., aluminum, fiberglass, clear-coat), the stage of surface finishing, the ending smoothness required, the speed at which a customer requires work to be completed, the liquid polish used, cost, and other like factors. The same factors dictate the size of the pads employed. Pads come in various sizes, for example in 4, 5, 5¼, 6, 7, and 12-inch diameters.

During polishing, it is often desirable to apply a polishing compound to a surface to aide in polishing. The compound is often in liquid form, but can also be a general fluid form. In practice, liquid polish is often squirted from a bottle onto the work surface. Squirting the polishing liquid from a bottle usually involves a user stopping and setting down the buffing machine, picking up the bottle, squirting liquid polish onto the surface from the bottle, then picking up the buffing machine and restarting it. Such a process tends to be tedious and time consuming.

During sanding, water or oil can be applied to a work surface to reduce dust and lubricate and cool the tool and surface. Other fluids, such as air or inert gases can be dispensed (i.e., blown) on the surface for cooling as well.

Attempts have been made in the prior art to incorporate a liquid polish dispensing mechanism into a rotary polisher. However, such designs typically involve a redesign of the polisher so that components such as reservoirs, tubing, pumps, and nozzles can be plumbed inside the polisher. Also, integrated dispensers are not normally easily removed for cleaning. Some prior art designs dispense polish underneath the center of the buffing pad. However, with such designs it is difficult for an operator to see exactly when and how much product is dispensed when the finishing disk is held against the work surface and/or is spinning.

There exists a need for an improved liquid polish dispenser.

BRIEF SUMMARY

Embodiments in accordance with the present disclosure relate to liquid polish dispensers for use with rotary polishers or other hand-held surface finishing tools. For example, certain embodiments relate to a liquid polish dispenser which can be longitudinally attached to a hand-held rotary polisher or other hand-operable surface finishing power tools such that a thumb-switch to operate the dispenser is conveniently placed proximal to and optionally opposite a trigger on the tool's handle. The dispenser can be firmly attached to rotary polishers by a strap strategically placed to avoid vent holes on the polishers. The thumb-switch activates an electric pump which pumps liquid polish through a nozzle and onto a work surface so that the user can easily determine how much and control the amount of liquid polish product that is dispensed.

Alternate embodiments relate to a liquid polish dispenser that has a mounting bracket that is left on the rotary polisher. The mounting bracket can fit on multiple makes/models of rotary polishers. The mounting bracket has a large hole through which a portion of the dispenser can fit and 'snap' into position. For example, a circular portion of the dispenser can fit into the hole, and then the whole dispenser is turned to engage pins or other tabs on the circular portion with the bracket. This can act like a large bayonet mount so that the dispenser can be secured to or removed from the rotary polisher. The elongated housing of the dispenser acts as a moment arm so that twisting the dispenser to get it off the device can be accomplished with little force. Even with slippery buffing compound splattered all over or gloved hands, and operator can remove or secure a dispenser to the bracket and tool.

Another embodiments mount the dispenser so that it hangs off a front end of a rotary polisher. This can be useful for household rotary polishers that are smaller than the large buffer shown in FIG. 1. Hanging the dispenser off the front of the tool may provide better balance to the tool. Other embodiments relate to a delivery tube that protrudes off-center from the front of the device, so that it is easier to see directly in front of the device from the operator's point of view.

One embodiment relates to a detachable fluid dispenser for a hand-operable surface finishing power tool. The dispenser typically includes an elongated casing adapted to attach longitudinally to a hand-operable surface finishing power tool, an attachment mechanism adapted to detachably secure the dispenser to the tool, and a container attachment mechanism adapted to removably hold a fluid container. The dispenser also typically includes a product delivery tube routed from the casing over the exterior of the tool connecting to a nozzle, and an electric pump coupled to the delivery tube. The pump is typically adapted to receive fluid from an attached fluid container and pump the fluid through the tube and nozzle.

Another embodiment relates to a detachable fluid dispenser for a hand-operable surface finishing power tool. The dispense typically includes an elongated casing adapted to attach longitudinally to a hand-operable surface finishing power tool, means for detachably securing the dispenser to the tool, and means for attachment of a fluid container to the casing. The dispenser also typically includes a product delivery tube routed from the casing over the exterior of the tool connecting to a nozzle and an electric pump coupled to the delivery tube. The pump is typically adapted to receive fluid from an attached container and pump the fluid through the tube and nozzle.

Yet another embodiment relates to a detachable, liquid polish dispenser for a hand-held rotary polisher. The dispenser typically includes an elongated casing adapted to attach longitudinally to a hand-held rotary polisher, a strap adapted to secure the dispenser to the polisher, means for rigid attachment of a liquid container to the casing, and an electric pump adapted to receive liquid from the container. The dispenser also typically includes a feed line routed from the casing along an exterior of the polisher to a distal end of the polisher and a nozzle extending over the polisher. The nozzle is typically connected to the feed line and directed to dispense liquid directly onto a surface to be polished.

An embodiment relates to a detachable fluid dispenser for a hand-operable surface finishing power tool. The, dispenser includes a rigid bracket configured to mount to a hand-operable surface finishing power tool, an elongated housing having a switch, the housing configured to removably attach to the bracket, the elongated housing configured to extend at least partially over a grip region of an attached hand-operable tool such that the switch is accessible to a finger on a hand that grips the tool without interrupting the grip, a container attachment mechanism adapted to attach a fluid container to the housing, a product delivery tube, and an electric pump coupled to the delivery tube, the pump adapted to receive a fluid from an attached fluid container and pump the fluid through the tube, thereby dispensing the fluid An embodiment relates to a detachable fluid dispenser for a hand-operable surface finishing power tool. The dispenser includes a bracket configured to semi-permanently mount to a hand-operable surface finishing power tool, a housing having a switch, the housing configured to removably attach to the bracket, the housing configured to extend at least partially over a grip region of an attached hand-operable tool such that the switch is accessible to a finger on a hand that grips the tool without interrupting the grip, means for detachably securing the housing to the bracket, means for attachment of a fluid container to the housing, a product delivery tube, and an electric pump coupled to the delivery tube, the pump adapted to receive a fluid from an attached fluid container and pump the fluid through the tube, thereby dispensing the fluid.

Another embodiment relates to a method of assembling a detachable fluid dispenser for a hand-operable surface finishing power tool. The method includes attaching a bracket to a hand-operable surface finishing power tool, inserting a protruding section of a detachable fluid dispenser housing into a hole in the bracket, pushing laterally at an end of the housing distal to the protruding section such that the housing rotates, and rotating the housing so that tabs of the protruding section mate against the bracket.

A further understanding of the nature and the advantages of the embodiments disclosed and suggested herein may be realized by reference to the remaining portions of the specification and the attached drawings.

DETAILED DESCRIPTION

Figure 2:
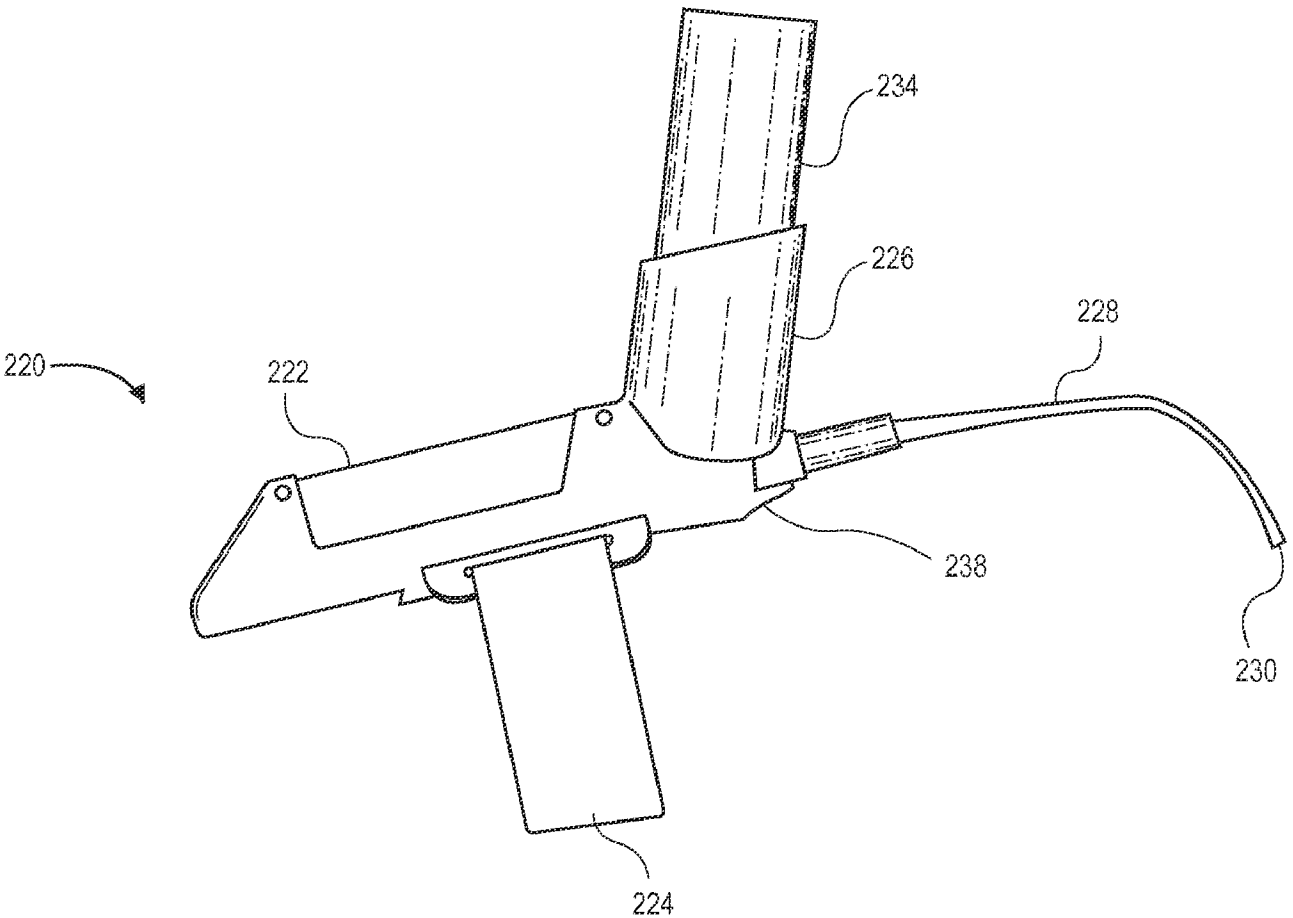
FIG. 2 is an illustration of detachable fluid dispenser in accordance with an embodiment.

FIG. 2 is an illustration of detachable fluid dispenser in accordance with an embodiment. With respect to FIG. 2, detachable fluid dispenser 220 includes elongated casing 222, strap 224, container attachment mechanism 226, product delivery tube 228, and nozzle 230. Dispenser 220 may be adapted to attach to any rotary polisher or other hand-held too. For example, in certain aspects, dispenser 220 is adapted to attach to several popular models of rotary polishers, and includes indentation 238 in order to rest on a popular polisher's dorsal resting block. A standard, over-the-counter, twelve-ounce spray bottle container 234 can be screwed snugly into threads (not shown) inside container attachment mechanism 226. It should be appreciated that other non-standard containers may be coupled with an appropriate attachment mechanism (e.g. threads).

Figure 1:
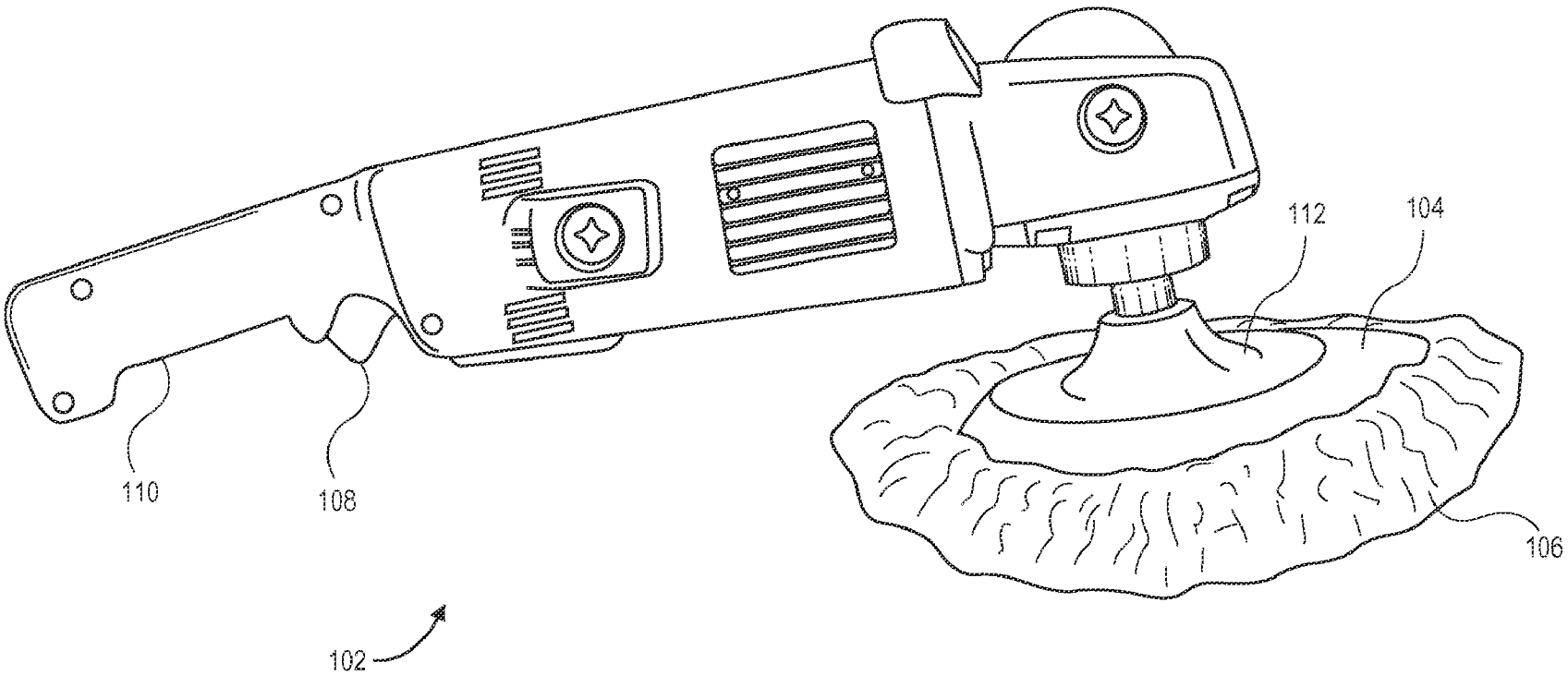
FIG. 1 (PRIOR ART)
FIG. 1 is a prior art illustration of a popular hand-held rotary polisher.
Figure 3:
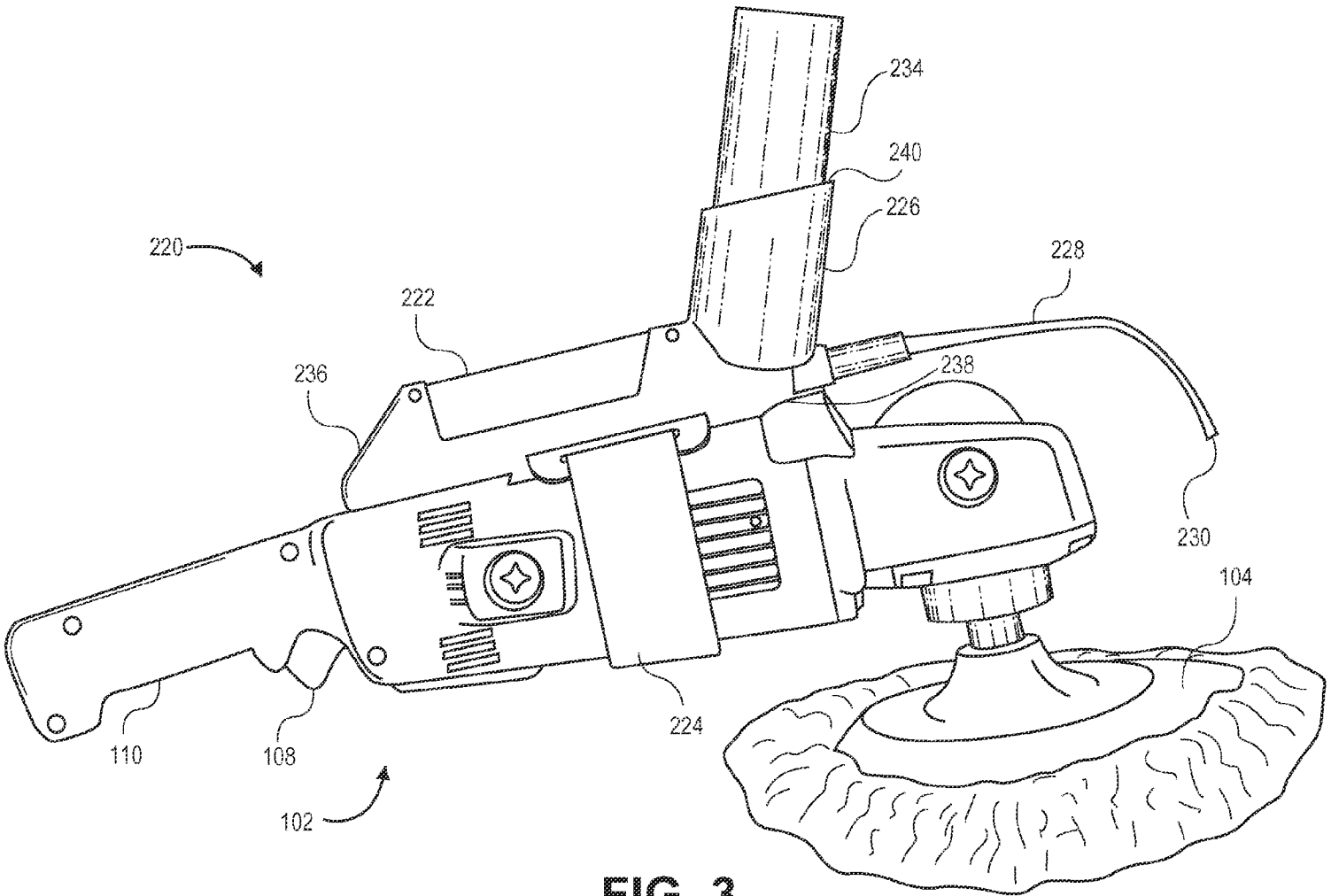
FIG. 3 is an illustration of the dispenser of FIG. 2 attached to the rotary polisher of FIG. 1.
Figure 4A:
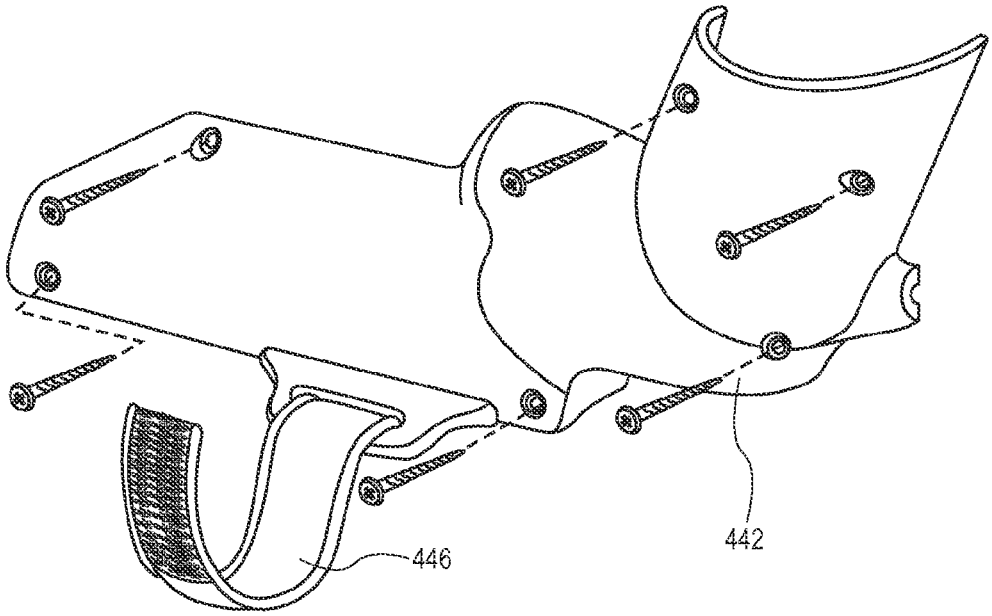
FIG. 4A is a perspective view of the outside of the right hand casing of the dispenser of FIG. 2.
Figure 4B:
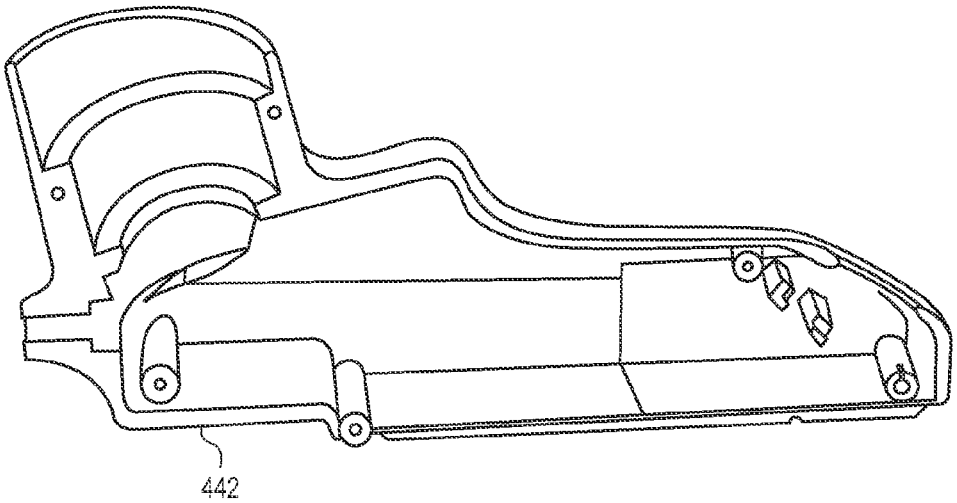
FIG. 4B is a perspective view of the inside of the right hand casing of the dispenser of FIG. 2.
Figure 5A:
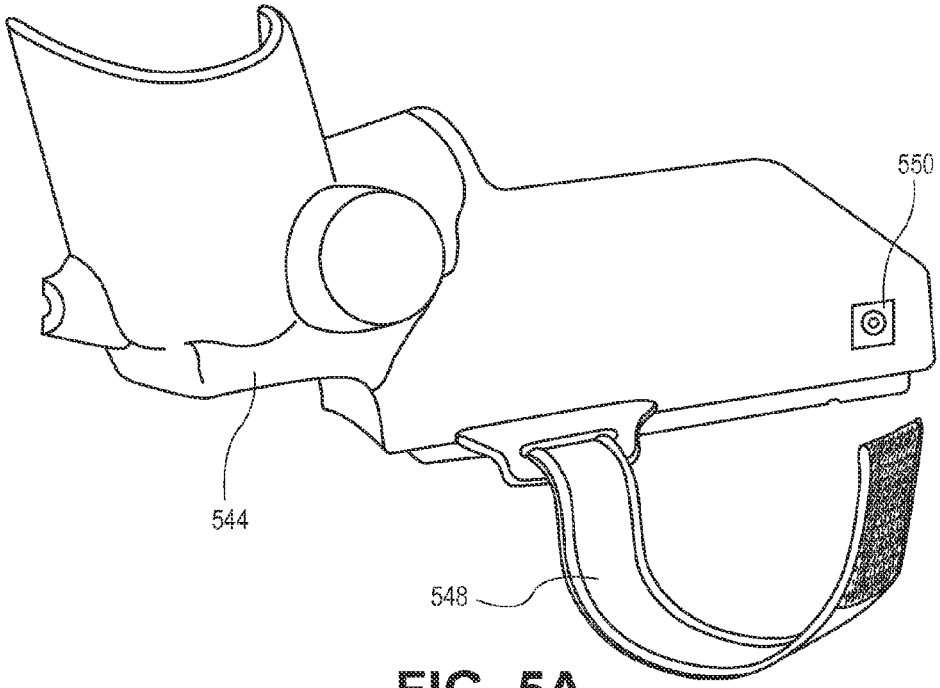
FIG. 5A is a perspective view of the outside of the left hand casing of the dispenser of FIG. 2.
Figure 5B:
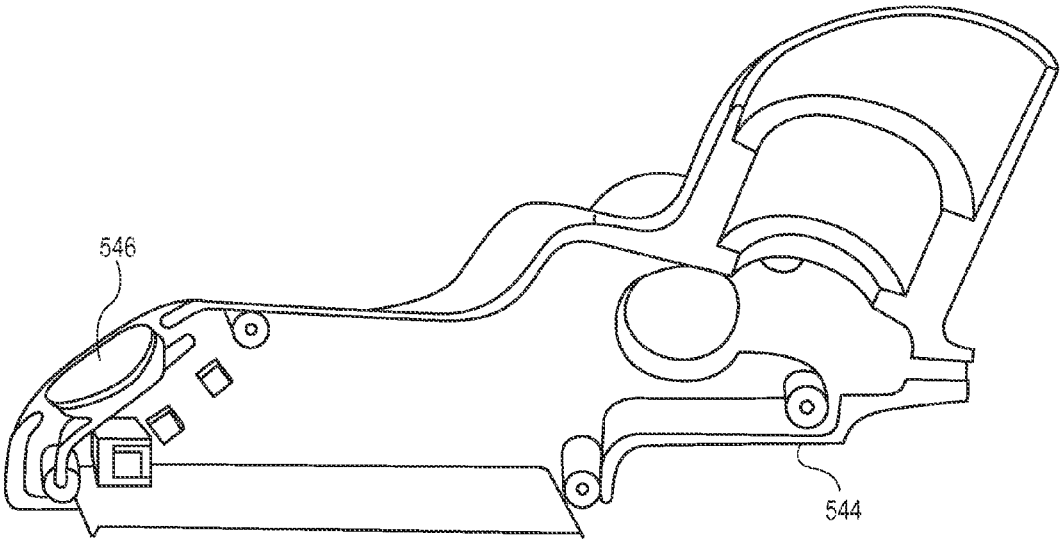
FIG. 5B is a perspective view of the inside of the left hand casing of the dispenser of FIG. 2.

FIG. 3 shows the dispenser of FIG. 2 attached to the rotary polisher of FIG. 1.

Elongated casing 222 is shown adapted to attach longitudinally using strap 224 to the polisher. Strap 224 can be made of a resilient material and can be secured over itself with hook-and-loop fasteners (e.g., VELCRO®), snaps, buckles, zippers, hook-and-eye closures, and other fasteners as would be apparent to one skilled in the art. A single 2½"-wide nylon strap, similar to a backpack strap, and clipped together with a male/female clip has been found to be effective. Strap 224 can also be made of a non-resilient material, such as metal, thermoplastic, or leather. Although non-resilient straps may not immediately conform to varied diameters of power finishing tools, non-resilient straps offer the opportunity to minimize inertial resonance of the tool and dispenser combination by more rigidly securing the dispenser to the tool.

In certain aspects, elongated casing 222 and strap 224 are adapted such that when the dispenser is attached, vent holes on various models of rotary polishers, such as the exemplary models discussed above, are unimpeded. Slight indentation 238 allows dispenser 220 to rest against one popular tool's dorsal resting block as shown in the figure.

Other removable attachment mechanisms besides a strap can be used, such as hooks, threaded studs with butterfly or knurled nuts, screws, clips, suction cups, hook-and-loop fasteners, and other releasable attachment mechanisms known in the art.

Longitudinally attaching the casing of the elongated dispenser to the power finishing tool advantageously shortens the distance between the centers of mass of the dispenser and tool and allows a greater contact region between the dispenser and tool for various attachment mechanisms. By reducing the distance between the centers of mass, the combined tool/dispenser is more akin to a single rigid body, rather than two coupled rigid bodies. Thus, the inertias of the dispenser and tool are more tightly phased and thus less likely to 'knock' against each other when the tool is vibrating. The greater contact region between the dispenser and tool allows a greater variety of attachment mechanisms and/or wider, broader, or more ergonomic attachment mechanisms to be used. In U.S. Pat. No. 3,104,783 to Hall and U.S. Pat. No. 5,649,508 to Rost et al., the disclosed dispensers are of cantilevered designs which generally increase the displacements caused by vibrations, especially near the distal ends of the dispensers, and require smaller attachment mechanisms.

A longitudinal attachment also advantageously helps minimize protrusions which can occlude an operator's view of the work surface or inadvertently bump into vehicle accessories (e.g., antennas, fog lights, side mirrors), inside edges, and other features on a vehicle being polished.

Running the elongated dispenser down the length of a polisher, such as one of the exemplary models described above, allows a thumb switch to be conveniently located near the handle of the polisher without separating the thumb switch from the main shell of the dispenser. As shown in FIG. 3, thumb switch 236 is oriented such that thumb switch 236 is operable by a thumb on a hand that grips handle 110 and squeezes trigger 108 with an index finger. Thus, thumb switch 236 can be operated without interrupting one's grip on handle 110.

In certain aspects, as shown, product delivery tube 228 is routed from casing 222 over the exterior of hand-operable surface finishing power tool 102 and connects to nozzle 230. A product delivery tube is sometimes called a feed line. Routing the tube outside the tool helps allow dispenser 220 to be more easily detached from tool 102, and also, if the tube is clear or translucent, gives an operator a clearer view of product as it moves through the tube. The operator may also be able to see obstructions, such as those caused by dried polish or contaminants, in the tube.

In certain aspects, container attachment mechanism 226 is positioned so that the opening (not shown) of container 234 is oriented downward during normal operation, e.g., fluid inside container 234 drains downward when connected to dispenser 220 and the tool is horizontal and finishing disk 104 is directed downward, substantially as shown. Thus, gravity assists in draining liquid polish from the bottle so that there is effectively more usable volume in the container than with a conventional siphon straw system, and less product is wasted. This can save on product costs, as well as reduce waste. Also, the pump being at the bottom is subjected to a higher head pressure from the liquid so that the pump operates more efficiently.

In certain aspects, a clear or translucent bottle serving as container 234 can be used to allow a user to see the amount of liquid left and rate at which it is consumed. Container attachment mechanism 226 positions container 234 out in front of a user so the user can more easily see the contents of the bottle. In certain aspects, a slight forward tilt of container 234 is provided as shown to help a user better view the product inside.

In one aspect, container attachment mechanism 226 includes sleeve 240 that surrounds the perimeter or circumference of container 234. If a seal between container 234 and container attachment mechanism 226 leaks, then such leakages are contained within sleeve 240, preventing a mess. Also, if extra liquid polish is left in container 234 when container 234 is unscrewed, the spillage will drain into cup-like sleeve 240.

FIGS. 4A-4B and 5A-5B illustrate different views of an exemplary dispenser casing. As shown, elongated casing 222 (see FIG. 2) can be comprised of right hand casing 442 and left hand casing 544. The two longitudinal halves can be assembled by screws, rivets, or other fasteners. Power receptacle 550 is usable for charging internal batteries. The assembly of left and right casings 442 and 544 can be sealed with a gasket or other adhesive in order to prevent outside contaminants or stray liquid polish from entering the casing. Thumb switch 236 (see FIG. 3) can include thumb pad 546 (see FIG. 5B), which can be sealed. Strap 224 can be comprised of right hand strap 446 and left hand strap 548, with hook-and-loop strips to releasably attach the right and left hand straps 446 and 548 to each other to form a solid strap.

Figure 6:
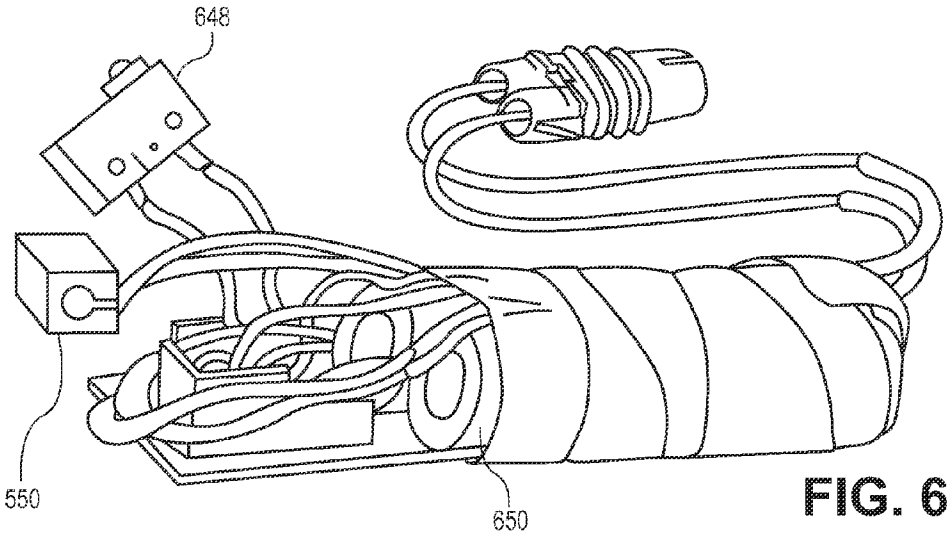
FIG. 6 is a perspective view of internal components of the dispenser in FIG. 2.

FIG. 6 illustrates various internal components of a dispenser according to one embodiment. As shown, thumb switch 236 (see FIG. 3) can comprise switch 648. Switch 648 controls the flow of electricity from battery 650. A set of lithium ion dry cells connected in series to create a 7.2-volt battery has been observed to provide enough power for a small fluid pump and last long enough for a complete polishing job. Battery 650 is recharged through receptacle 550.

Figure 7:
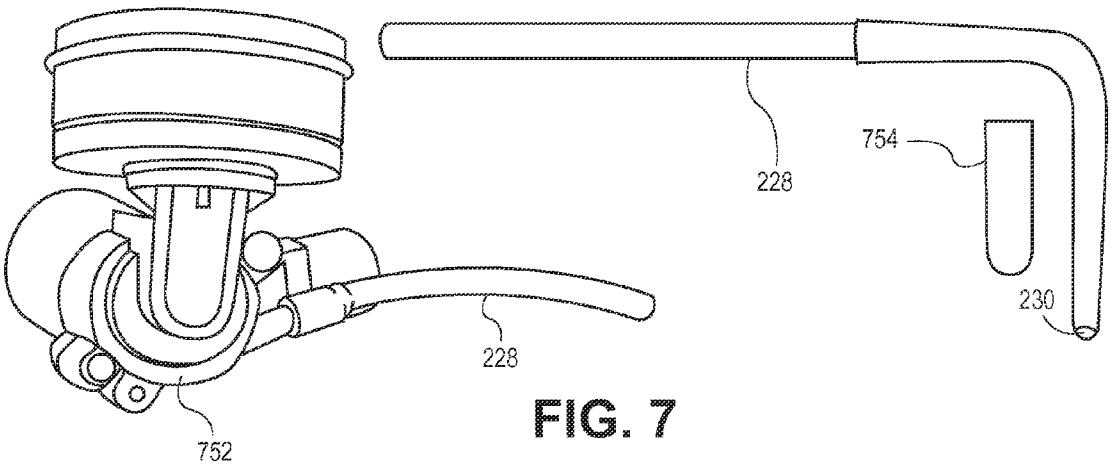
FIG. 7 is a perspective view of internal and external components of the dispenser in FIG. 2.

FIG. 7 illustrates components of the dispenser of FIG. 2. As shown, electric pump 752 is coupled to product delivery tube 228 and is adapted to receive fluid from container 234 (see FIG. 2) and pump the fluid through tube 228 and nozzle 230.

Figure 8:
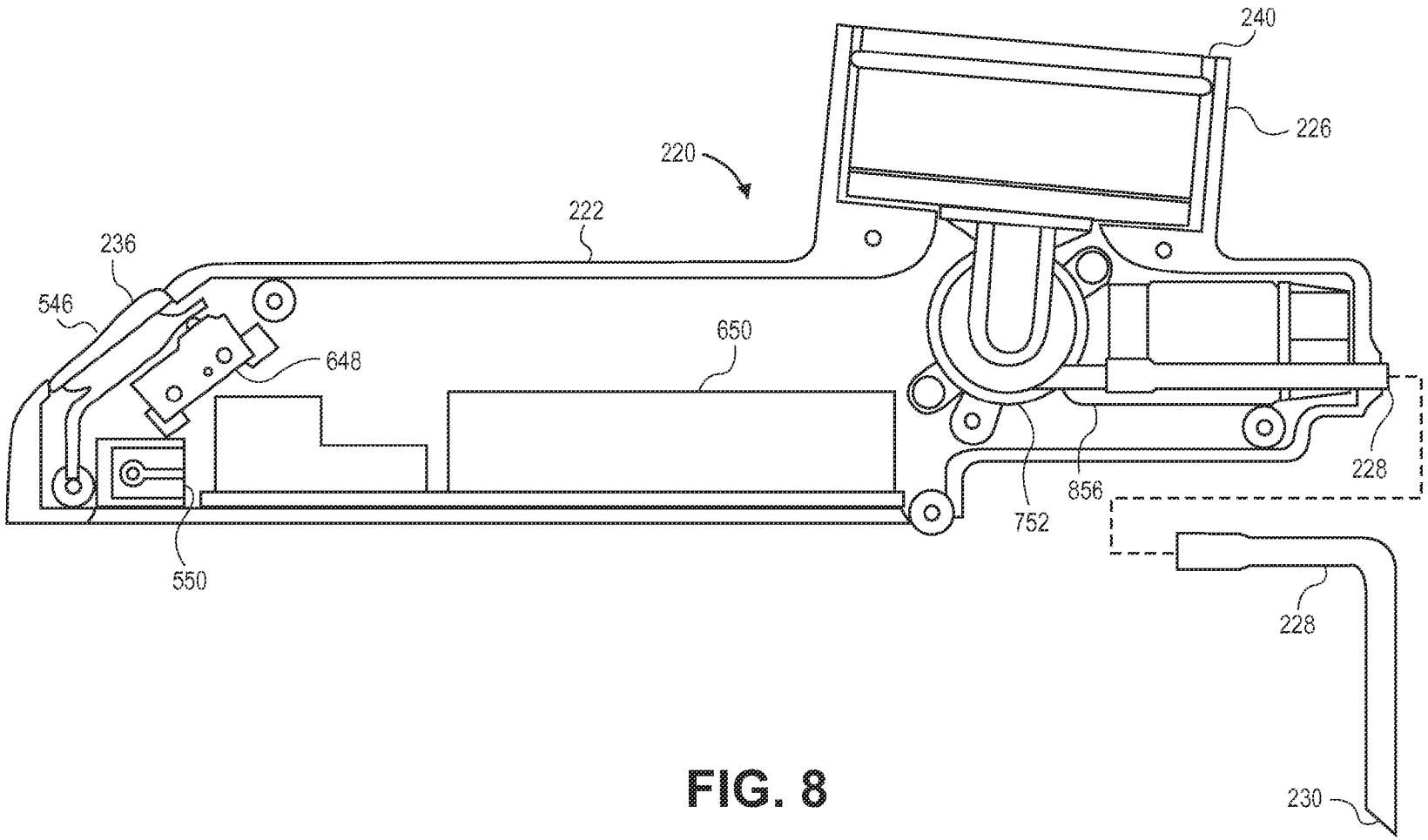
FIG. 8 is a vertical cross section of the dispenser of FIG. 2.

FIG. 8 is a vertical cross section of the dispenser of FIG. 2. Thumb switch 236 including thumb pad 546 and switch 648, receptacle 550, battery 650, electric pump 752, and a portion of product delivery tube 228 can be packaged inside elongated casing 222 as shown. Product delivery tube 228 is routed outside casing 222, over the exterior of the tool to nozzle 230. Container attachment mechanism 226, which can be integral to casing 222, can also be integral to sleeve 240.

If tool 102 has a suitable power receptacle, a power plug from dispenser 220 can be adapted to plug into the receptacle, thereby powering the dispenser. This can allow more power to be supplied to the pump than would otherwise be supplied by dry cell batteries and/or allow battery 650 to be constantly recharged. The use of a plug into a local power socket on the tool obviates any need for a separate power cord extending to a wall outlet if batteries are not used.

In certain aspects, nozzle 230 is covered by tube cap 754 (see FIG. 7) in order to prevent liquid polish from drying in the nozzle and to prevent spillage out nozzle 230.

To clean the internal wetted regions of dispenser 220, container 234 may be filled with water or another cleaning agent and the pump activated to flow water through pump 752, product delivery tube 228, and nozzle 230.

In certain aspects, pump 752 can also be operated in reverse by switching the polarity of the power by a double-pole double-throw (DPDT) toggle switch. This switch can be the same as thumb switch 236 or a separate switch. In reverse, pump 752 can sip water from a bucket in which nozzle 230 rests back through tube 228 and into container 234. This reverse pumping can be used for convenient cleaning. For example, at the end of a job and after the last of the usable liquid polish in container 234 is drained, the nozzle can be set in water and the pump reversed without unscrewing the container. This will not only flush the dispenser nozzle, tubes, and pump, but also wash container 234 with cleaning water. After container 234 is filled, pump 752 can then be reversed again (to forward operation) to pump out the dirty cleaning water from container 234. A few iterations of this method can clean the apparatus without the need to remove and replace container 234.

In some embodiments, the reverse pumping process can be used to fill container 234 with liquid polish by inserting the nozzle in a bottle of new polish. For example, at the beginning of a job the nozzle can be set in a new bottle of liquid polish, and the polish will be sucked into container 234. Container 234 is thus filled without removing it from dispenser 220.

Besides using the reverse pumping process for cleaning, reverse pumping can be used to dilute liquid polish in container 234 without the need to remove container 234 from the dispenser. For example, if liquid polish from the dispenser appears a bit too thick, an operator can submerge nozzle 230 in a pail of water and trigger the reverse pump. Water will be pumped backwards into container 234 and mix with the thick polish, thereby thinning or diluting the polish. The operator can then set the pump to forward flow and dispense a bit of liquid polish to test its consistency. The operator can repeat this process in small increments until the polish in container 234 is of the appropriate consistency.

Nozzle 230 and/or product delivery tube 228 can be made of resilient material, such as rubber or polyethylene. A soft, resilient nozzle helps prevent scratches and other damage to vehicles if the nozzle is caught on an edge or inadvertently jammed against a surface. A resilient nozzle also lessens the possibility of the nozzle breaking in such situations.

Nozzle 230 and/or product delivery tube 228 can also be curvilinear, helical, S-shaped, or otherwise serpentine such that the nozzle or tube is more resilient than it otherwise would be, given the same cross section and material of the tube and nozzle. Curves in a serpentine delivery tube can be sized such that the natural frequency of the tube is lower than or above that the normal operating frequency (RPM) of a rotary polisher.

In certain aspects, nozzle 230 is removable. A removable nozzle allows easier cleaning of the nozzle and distal end of product delivery tube 228 as well as the option of using different nozzles for different patterns (e.g., stream, heavy spray, fine spray patterns).

Referring back to FIG. 3, in certain aspects product delivery tube 228 and nozzle 230 extend no farther than the planform of the tool. The planform is the vertical boundary of a plan view of the tool. It has been found that containing the tube and nozzle within the planform boundary helps keep vibrations of the tool from unduly swinging the nozzle tip. Large swings in the nozzle while dispensing can result in product being slung unpredictably, such as toward the operator.

Referring again to FIG. 8, in one embodiment, a viscosity compensation mechanism 856 is integrated with pump 752 such that pump 752 pumps fluids with varying viscosities at substantially similar flow rates. Substantially similar flow rates include flow rates within ±10%, ±25%, or other similar rates to each other. Viscosity compensation mechanism 856 can include a sensor that senses fluid flow with feedback to a controller which controls pump speed, and can also include a governor such that pump 752 pumps at a constant speed for various fluid consistencies.

In certain aspects, dispenser 220 includes an indicator to indicate if attached container 234 has run dry. Such an indicator can include an audible alarm, an indicator light, a vibration change, a brief interruption in the pump motor windup, and other indicators. Also, indication may be provided to a user by the pump sounding different or by a deactivation of thumb switch 236.

Figure 9A:
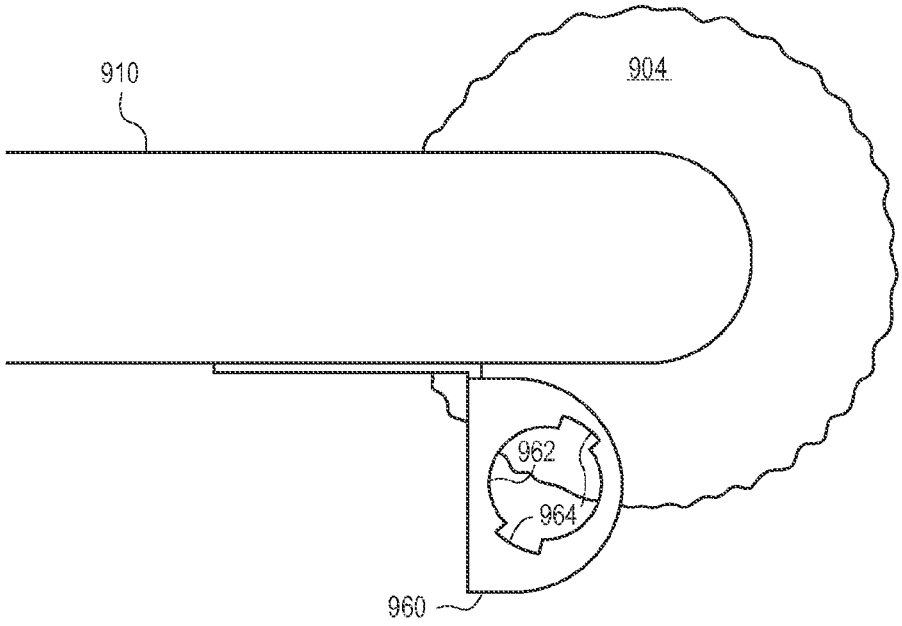
FIG. 9A is a top view of a power tool mounted with a bracket in accordance with an embodiment.

FIG. 9A is a top view of a power tool mounted with a bracket in accordance with an embodiment. Rotary power tool 910 with a circular foam pad 904 has bracket 960 mounted to its side. Bracket 960 has hole 962 and keyed areas 964.

Figure 9B:
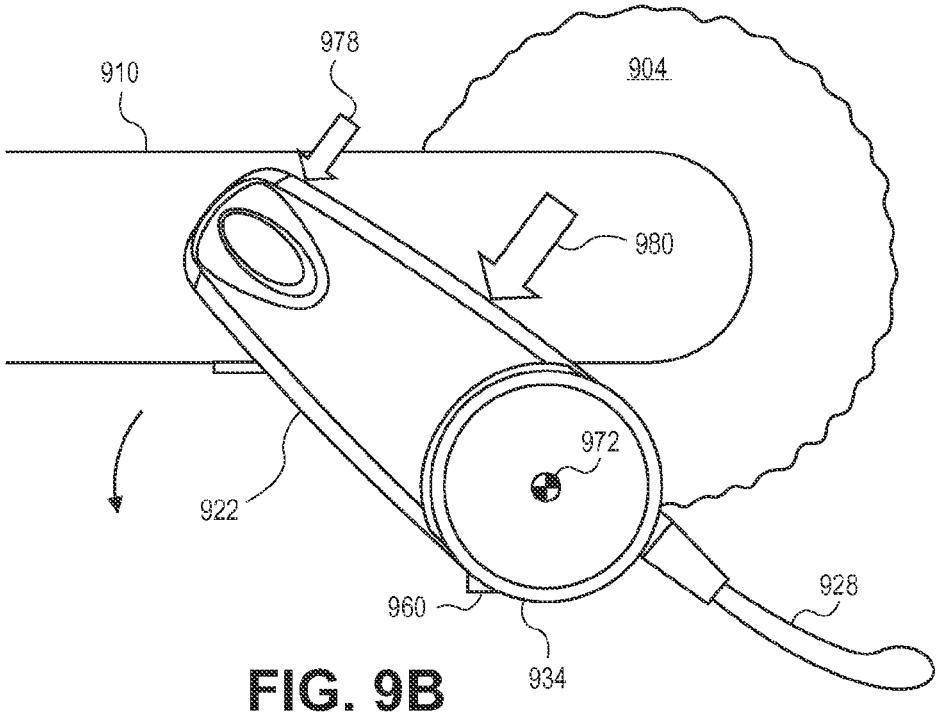
FIG. 9B is a top view of a dispenser being mounted to the bracket of FIG. 9A.

FIG. 9B is a top view of a dispenser being mounted to the bracket of FIG. 9A. Dispenser 922 has button 936 near the end of its elongated body and bottle 934. Dispenser 922 also has delivery tube 928.

To assemble the dispenser to the bracket, a cylindrical housing portion of dispenser 922 is set into circular hole 962 of bracket 960. The elongated dispenser is then rotated such that tabs on the cylindrical housing portion mate against the bracket.

The elongated body of the dispenser can be used as a moment arm in order to torque the dispenser's tabs firmly into place against the bracket. For example, in rotating the dispenser around rotational axis 972, a force applied laterally (tangentially) at position 978 can be less than force applied laterally at position 980 in order to seat the tabs against the bracket. Thus, not only does the elongated casing house batteries, a pump, etc. and extend to a user's comfortable thumb position on the tool, the elongated casing helps a user seat the dispenser solidly on the tool. The elongated housing and moment arm can allow a gloved user to easily join and separate the device from the housing, even when everything is slippery from splattered liquid polish. Furthermore, one does not need to twist or even touch the cylindrical fluid dispenser, risking a spill, in order to separate or join the dispenser to the tool.

Figure 9C:
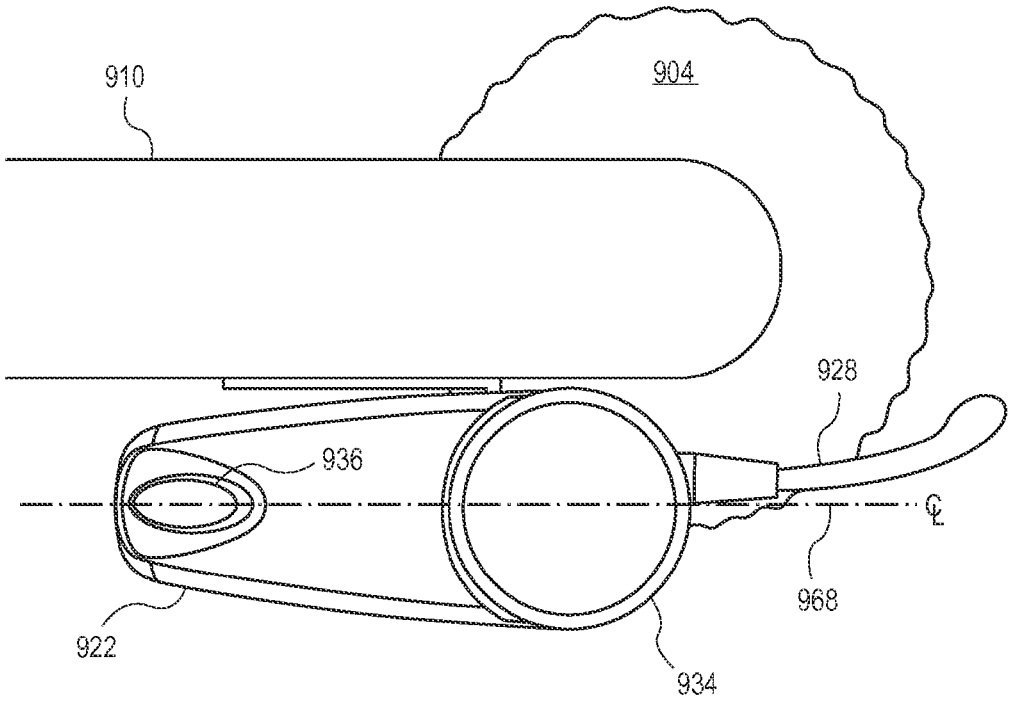
FIG. 9C is a top view of the dispenser of FIG. 9B being rotatably attached to the bracket of FIG. 9A.

FIG. 9C is a top view of the dispenser of FIG. 9B being rotatably attached to the bracket of FIG. 9A. Dispenser 922 is now seated in parallel against and overhangs a side of power tool 910. Product delivery tube 928 stretches over circular foam pad 904. The product delivery tube protrudes off-center from longitudinal centerline 968 of dispenser 922 such that it is closer to the side-mounted tool. In the side-mounted configuration, the tube can be shorter than if it were in the center of the tool because its end clears a side of the circular foam pad.

Figure 10C:
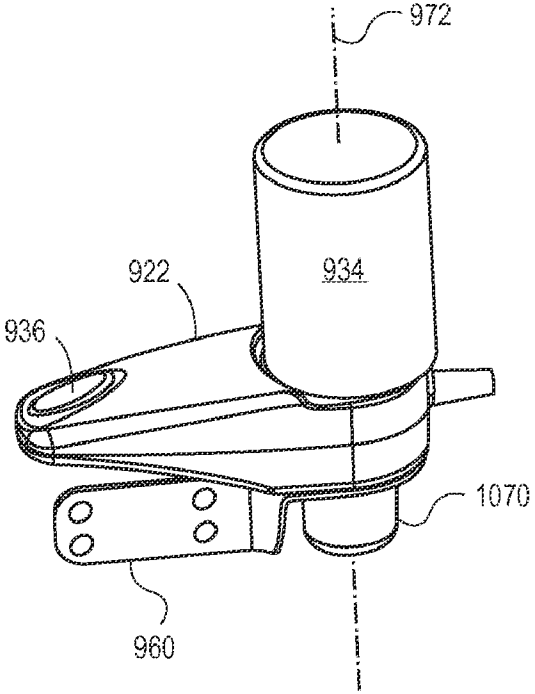
FIG. 10C is a top-side oblique view of the dispenser being twisted to secure it to the bracket of FIG. 10B.
Figure 10B:
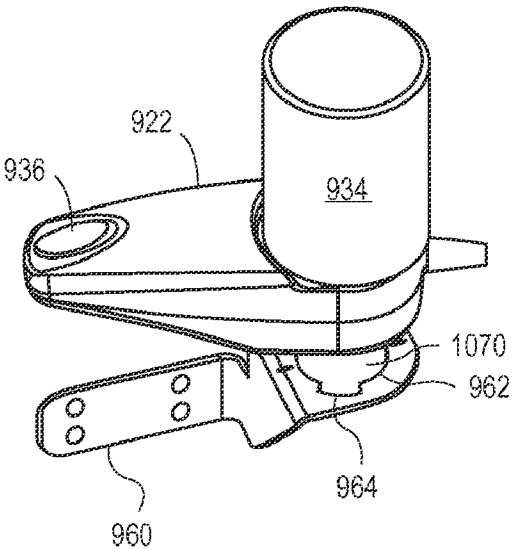
FIG. 10B is a top-side oblique view of the dispenser being lowered into the bracket of FIG. 10A.
Figure 10A:
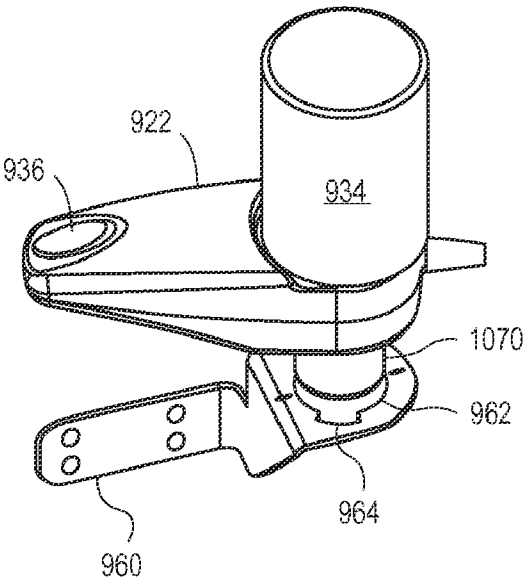
FIG. 10A is a top-side oblique view of a dispenser being aligned over a bracket in accordance with an embodiment.

FIG. 10A is a top-side oblique view of a dispenser being aligned over a bracket in accordance with an embodiment. For clarity, an attached power tool is not shown. Dispenser 922 with button 936 and bottle 934 is aligned over bracket 960 such that the dispenser's circular portion 1070 and tabs are aligned with hole 962 and keyed areas 964.

FIG. 10B is a top-side oblique view of the dispenser being lowered into the bracket of FIG. 10A. Circular portion 1070 passes through circular hole 962, and the tabs pass through keyed areas 964.

FIG. 10C is a top-side oblique view of the dispenser being twisted to secure it to the bracket of FIG. 10B. The elongated housing of dispenser 922 is rotated around rotational axis 972 such that the tabs rotate away from keyed areas 964 and grip against the non-keyed areas of bracket 960.

Within circular section 1070 is an electric motor for the pump. Because the motor is rotary, it is cylindrical and is in a convenient shape for the circular protrusion. The metal mounting bracket, wrapping around the circular protrusion in which the motor is mounted, helps dissipate heat from the motor. Also, the mounting bracket wrapping directly around the area of the motor increases the natural frequency of the coupled combination so that vibrations of the motor, if unbalanced by varying densities of polishing compound, do not excessively shake the tool.

Figure 11C:
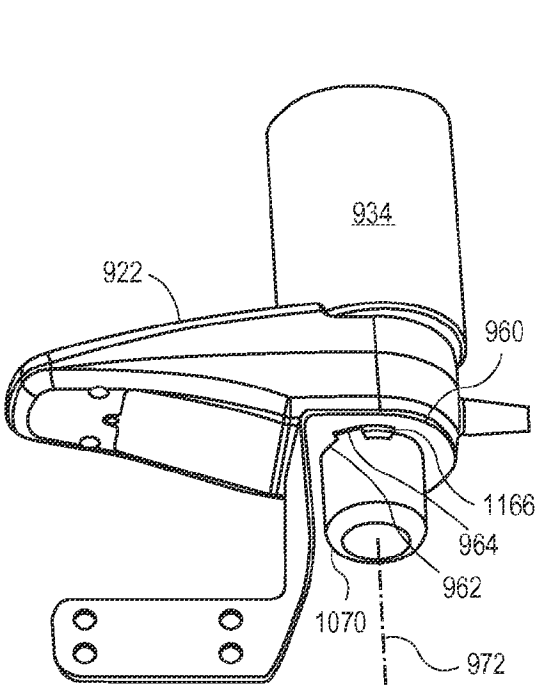
FIG. 11C is a bottom-side oblique view of the dispenser being twisted to secure it to the bracket of FIG. 11B.
Figure 11B:
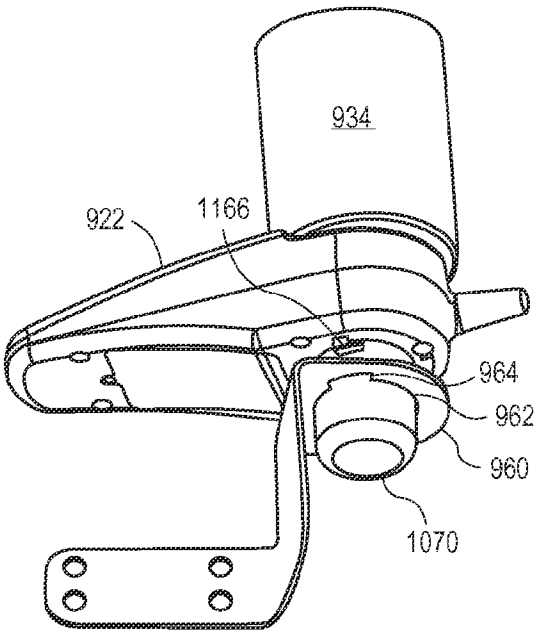
FIG. 11B is a bottom-side oblique view of the dispenser being lowered into the bracket of FIG. 11A.
Figure 11A:
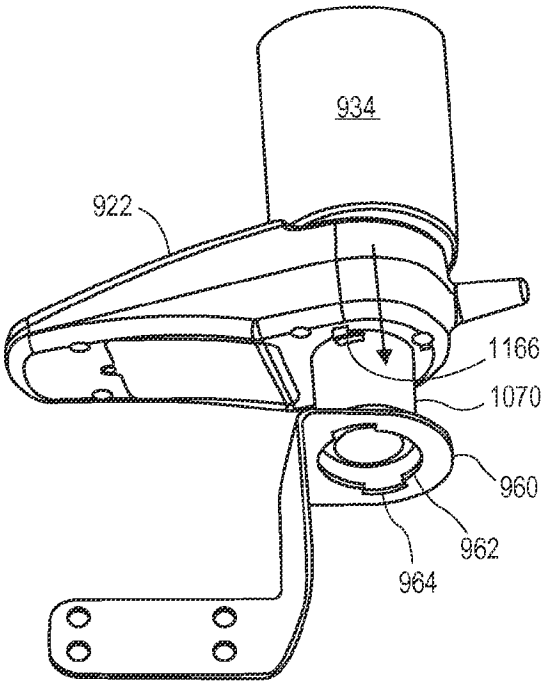
FIG. 11A is a bottom-side oblique view of a dispenser being aligned over a bracket in accordance with an embodiment.

FIG. 11A is a bottom-side oblique view of a dispenser being aligned over a bracket in accordance with an embodiment. As in FIG. 10A, dispenser 922 with bottle 934 is aligned over bracket 960 such that its circular portion 1070 and tabs 1166 are aligned with hole 962 and keyed areas 964.

FIG. 11B is a bottom-side oblique view of the dispenser being lowered into the bracket of FIG. 11A. As in FIG. 10B, circular portion 1070 of dispenser 922 passes through circular hole 962. Tabs 1166 are set to pass clear through keyed areas 964.

FIG. 11C is a bottom-side oblique view of the dispenser being twisted to secure it to the bracket of FIG. 11B. The elongated housing of dispenser 922 has been rotated around rotational axis 972 such that tabs 1166 rotate away from keyed areas 964 and grip against the non-keyed areas of bracket 960.

Dispenser 922 can be removed from the bracket and tool by performing the above operations in reverse order.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive.

What is claimed is:

1. A detachable fluid dispenser for a hand-operable surface finishing power tool, comprising:

a rigid bracket configured to mount to a hand-operable surface finishing power tool;

an elongated housing having a switch, the housing configured to rotatably and removably attach to the bracket, the elongated housing configured to extend at least partially toward a grip region of an attached hand-operable tool such that the switch is accessible to a finger on a hand that grips the tool without interrupting the grip;

a container attachment mechanism adapted to attach a fluid container to the housing;

a product delivery tube; and a pump coupled to the product delivery tube, the pump adapted to receive a fluid from an attached fluid container and pump the fluid through the tube, thereby dispensing the fluid.

2. The dispenser of claim 1 further comprising:

a protruding section of the housing with tabs, the protruding section configured to slip through a hole of the bracket and be releasably secured to the bracket by rotating the housing about a rotation axis so that the tabs mate against the bracket.

3. The dispenser of claim 2 wherein the housing is elongated along an direction that is radial to the rotation axis, such that the elongated direction of the housing can function as a moment arm when rotating the housing to secure it to the bracket.

4. The dispenser of claim 1 wherein a majority of the housing hangs over a side of the tool when the housing is mounted to the bracket.

5. The dispenser of claim 1 wherein a majority of the housing hangs over a front of the tool when the housing is mounted to the bracket.

6. The dispenser of claim 1 wherein a majority of a fluid container attached to the container attachment mechanism hangs over the front of the tool when the housing is mounted to the bracket.

7. The dispenser of claim 1 wherein the bracket was fabricated by bending a single piece of flat metal.

8. The dispenser of claim 1 wherein the tube protrudes off-center from a longitudinal centerline of the housing.

9. The dispenser of claim 1 wherein the bracket has slotted holes adapted for mounting screws.

10. The dispenser of claim 1 wherein the switch is a button.

11. The dispenser of claim 1 wherein the finger is a thumb.

12. The dispenser of claim 1 further comprising a battery connected to the switch and the pump, wherein upon activation of the switch, the battery supplies power to the pump.

13. The dispenser of claim 1 wherein the container attachment mechanism is adapted such that an attached container drains downward when connected to the dispenser, such that fluid flow is assisted by gravity when a finishing disk of an attached tool is horizontal and directed downward.

14. The dispenser of claim 1 wherein the container attachment mechanism comprises a sleeve that surrounds a perimeter of the container such that leakages from an opening in the container are contained in the sleeve.

15. The dispenser of claim 1 further comprising a reverse switch adapted to reverse the electric pump such that water can be sucked from the nozzle through the tube back into the attached fluid container.

16. The dispenser of claim 1 wherein the hand-operable surface finishing power tool is a rotary polisher.

17. An assembly comprising:

a hand-operable surface finishing power tool; and the dispenser of claim 1 mounted to the tool.

18. The assembly of claim 16 further comprising:

a fluid container mounted to the housing.

19. A detachable fluid dispenser for a hand-operable surface finishing power tool, comprising:

a rigid bracket configured to semi-permanently mount to a hand-operable surface finishing power tool;

a housing having a switch, the housing configured to rotatably and removably attach to the bracket, the housing configured to extend at least partially toward a grip region of an attached hand-operable tool such that the switch is accessible to a finger on a hand that grips the tool without interrupting the grip;

means for detachably securing the housing to the bracket;

means for attachment of a fluid container to the housing;

a product delivery tube; and a pump coupled to the delivery tube, the pump adapted to receive a fluid from an attached fluid container and pump the fluid through the tube, thereby dispensing the fluid.

20. A method of assembling a detachable fluid dispenser for a hand-operable surface finishing power tool, the method comprising:

attaching a bracket to a hand-operable surface finishing power tool;

inserting a protruding section of a detachable fluid dispenser housing into a hole in the bracket;

pushing laterally at an end of the housing distal to the protruding section such that the housing rotates; and rotating the housing so that tabs of the protruding section mate against the bracket.

* * * * *